US007540380B2

(12) United States Patent
Kohs et al.

(10) Patent No.: US 7,540,380 B2
(45) Date of Patent: Jun. 2, 2009

(54) ROLLER REST ENCLOSURE

(75) Inventors: Stephen C. Kohs, Forest Lake, MN (US); Dion M. McDevitt, Ramsey, MN (US)

(73) Assignee: Diversified Dynamics Corporation, Minneapolis, MN (US)

( * ) Notice: Subject to any disclaimer, the term of this patent is extended or adjusted under 35 U.S.C. 154(b) by 455 days.

(21) Appl. No.: 11/188,900

(22) Filed: Jul. 25, 2005

(65) Prior Publication Data

US 2007/0017836 A1 Jan. 25, 2007

(51) Int. Cl.
*B65D 83/10* (2006.01)

(52) U.S. Cl. ..... 206/361; 206/15.3

(58) Field of Classification Search ..... 206/361, 206/15.2, 15.3; 15/248.2, 257.06
See application file for complete search history.

(56) References Cited

U.S. PATENT DOCUMENTS

| | | | |
|---|---|---|---|
| 615,751 | A | 12/1898 | Sands |
| 1,186,088 | A | 6/1916 | Finlay |
| 1,268,271 | A | 6/1918 | Nelson |
| 1,428,079 | A | 9/1922 | Clark |
| 1,691,024 | A | 11/1928 | Gedge |
| 1,714,350 | A | 5/1929 | De Jong |
| 1,875,574 | A | 9/1932 | Duncan |
| 2,011,635 | A | 8/1935 | Homan |
| 2,082,582 | A | 6/1937 | Kling |
| 2,249,401 | A | 7/1941 | Sieg |
| 2,281,367 | A | 4/1942 | Moll |
| 2,301,586 | A | 11/1942 | Rubin |
| 2,350,469 | A | 6/1944 | Litka |
| 2,443,981 | A | 6/1948 | Funk et al. |
| 2,517,551 | A | 8/1950 | Eckman |
| 2,521,967 | A | 9/1950 | Dean |
| 2,557,214 | A | 6/1951 | Bales |
| 2,564,721 | A | 8/1951 | Raya |
| 2,576,192 | A | 11/1951 | Poznik |
| 2,613,384 | A | 10/1952 | Collins |
| 2,632,904 | A | 3/1953 | Halecky |
| 2,647,273 | A | 8/1953 | Eagle |
| 2,682,071 | A | 6/1954 | Linderoth |
| 2,685,702 | A | 8/1954 | Jones |
| 2,722,029 | A | 11/1955 | Barnes et al. |

(Continued)

FOREIGN PATENT DOCUMENTS

| | | |
|---|---|---|
| AU | 129491 | 2/1947 |

(Continued)

OTHER PUBLICATIONS

HomeRight Instructional Packet, "Electric Power-Flo Roller Instructions," (12 pgs.).

(Continued)

*Primary Examiner*—J. Gregory Pickett
(74) *Attorney, Agent, or Firm*—Gerald E. Helget; Nelson R. Capes; Briggs and Morgan, P.A.

(57) ABSTRACT

An apparatus for temporarily storage of paint roller sleeves, the roller cage, and a portion of the handle assembly. The apparatus consists of an enclosure receiving the roller sleeve, the roller cage, and a portion of the handle assembly and also fully enclosing the roller sleeve and the roller cage.

11 Claims, 3 Drawing Sheets

U.S. PATENT DOCUMENTS

| | | | | | |
|---|---|---|---|---|---|
| 2,727,268 | A | | 12/1955 | Hucke | |
| 2,805,646 | A | | 9/1957 | Shlesinger, Jr. | |
| 2,825,916 | A | | 3/1958 | Basala, Jr. | |
| 2,856,622 | A | | 10/1958 | Jacobsen | |
| 2,916,755 | A | | 12/1959 | De Bozzay | |
| 2,964,769 | A | | 12/1960 | Mercereau | |
| 2,997,732 | A | | 8/1961 | Gilchrist et al. | |
| 3,000,040 | A | | 9/1961 | Carlson | |
| 3,020,579 | A | | 2/1962 | O'Connor | |
| 3,103,690 | A | | 9/1963 | Day | |
| 3,114,922 | A | | 12/1963 | Ballantyne | |
| 3,148,401 | A | | 9/1964 | Gilchrist et al. | |
| 3,166,775 | A | | 1/1965 | Cushman | |
| 3,170,182 | A | | 2/1965 | Burian | |
| 3,175,242 | A | | 3/1965 | Kamondy et al. | |
| 3,195,170 | A | | 7/1965 | Howard | |
| 3,210,794 | A | | 10/1965 | Vosbikian | |
| 3,231,151 | A | | 1/1966 | Clark et al. | |
| 3,337,899 | A | | 8/1967 | Rentfrow | |
| 3,369,268 | A | | 2/1968 | Burns et al. | |
| 3,418,054 | A | | 12/1968 | Kirch | |
| 3,422,844 | A | | 1/1969 | Grise | |
| 3,455,638 | A | | 7/1969 | Braswell | |
| 3,457,017 | A | | 7/1969 | Bastian | |
| 3,459,482 | A | | 8/1969 | Fears | |
| 3,476,507 | A | | 11/1969 | Leeds | |
| 3,504,699 | A | | 4/1970 | Grisé | |
| 3,554,659 | A | | 1/1971 | Stokes | |
| 3,612,707 | A | | 10/1971 | Herbrechter | |
| 3,623,179 | A | | 11/1971 | Roth | |
| 3,702,739 | A | | 11/1972 | Rentfrow | |
| 3,713,744 | A | | 1/1973 | Sims | |
| 3,734,149 | A | | 5/1973 | Hansel | |
| 3,766,879 | A | | 10/1973 | Jones | |
| 3,774,252 | A | | 11/1973 | Cantales | |
| 3,776,645 | A | | 12/1973 | Walker | |
| 3,783,469 | A | | 1/1974 | Siemund | |
| 3,822,720 | A | | 7/1974 | Souza | |
| 3,837,381 | A | | 9/1974 | Arroyo | |
| 3,837,747 | A | | 9/1974 | Seymore | |
| 3,850,408 | A | | 11/1974 | Shelnick | |
| 3,918,582 | A | * | 11/1975 | Wallace | 206/362 |
| 4,032,239 | A | | 6/1977 | Maupin | |
| 4,066,366 | A | | 1/1978 | Reynolds | |
| 4,067,414 | A | | 1/1978 | Funke | |
| 4,119,386 | A | | 10/1978 | Cushing | |
| 4,142,540 | A | * | 3/1979 | Vegiard | 134/138 |
| 4,200,949 | A | * | 5/1980 | Heniff, Jr. | 15/257.6 |
| 4,217,062 | A | | 8/1980 | Trp et al. | |
| 4,231,668 | A | | 11/1980 | Groth et al. | |
| 4,291,491 | A | | 9/1981 | Maddock | |
| 4,312,093 | A | | 1/1982 | Raab | |
| 4,315,342 | A | | 2/1982 | Ash | |
| 4,324,018 | A | | 4/1982 | Olsson | |
| 4,357,779 | A | | 11/1982 | Maddock | |
| 4,434,810 | A | | 3/1984 | Atkinson | |
| 4,436,519 | A | | 3/1984 | O'Neill | |
| 4,467,533 | A | * | 8/1984 | Sica | 34/58 |
| 4,475,262 | A | | 10/1984 | Downer | |
| 4,540,301 | A | | 9/1985 | Swanson et al. | |
| 4,611,941 | A | | 9/1986 | Karliner et al. | |
| 4,639,156 | A | | 1/1987 | Stern et al. | |
| 4,695,176 | A | | 9/1987 | Simonette et al. | |
| 4,732,503 | A | | 3/1988 | Bader et al. | |
| 4,738,358 | A | * | 4/1988 | Kehl | 206/207 |
| 4,810,123 | A | | 3/1989 | Bruggeman | |
| 4,822,194 | A | | 4/1989 | Simonette | |
| 4,852,210 | A | | 8/1989 | Krajicek | |
| 4,944,623 | A | | 7/1990 | McNeil | |
| 4,971,471 | A | | 11/1990 | Sloan | |
| 4,997,302 | A | | 3/1991 | Simonette | |
| 5,020,181 | A | | 6/1991 | Leonard | |
| 5,074,098 | A | * | 12/1991 | Filipchuk | 53/397 |
| 5,167,055 | A | | 12/1992 | Stoddart et al. | |
| 5,178,274 | A | * | 1/1993 | Long | 206/361 |
| 5,272,782 | A | | 12/1993 | Hutt | |
| 5,425,589 | A | | 6/1995 | Griffin et al. | |
| 5,440,853 | A | * | 8/1995 | Engdahl | 53/432 |
| 5,533,617 | A | * | 7/1996 | Von Flatern | 206/361 |
| 5,594,971 | A | | 1/1997 | Nelson | |
| 5,613,264 | A | | 3/1997 | Knowles | |
| 5,661,865 | A | * | 9/1997 | Humphrey | 15/3 |
| 5,709,301 | A | * | 1/1998 | Couch et al. | 206/361 |
| 5,915,522 | A | | 6/1999 | Clarke | |
| 5,915,552 | A | * | 6/1999 | Kim et al. | 206/361 |
| 5,992,617 | A | * | 11/1999 | Couch et al. | 206/15.3 |
| 6,109,811 | A | | 8/2000 | Song | |
| 6,142,693 | A | | 11/2000 | Bruggeman et al. | |
| 6,244,771 | B1 | | 6/2001 | Bruggeman et al. | |
| D444,928 | S | | 7/2001 | Bruggeman et al. | |
| D476,122 | S | | 6/2003 | Bruggeman et al. | |
| 2001/0025394 | A1 | | 10/2001 | Napolitan | |
| 2004/0188276 | A1 | * | 9/2004 | Petrehn | 206/15.3 |
| 2007/0295626 | A1 | * | 12/2007 | Mowe et al. | 206/361 |

FOREIGN PATENT DOCUMENTS

| | | |
|---|---|---|
| CA | 784908 | 5/1968 |
| EP | 0572236 | 1/1998 |
| EP | 1120289 A1 | 8/2001 |
| GB | 735590 | 8/1955 |
| GB | 868894 | 5/1961 |
| GB | 2094443 | 9/1982 |
| GB | 2148154 | 5/1985 |
| GB | 2155147 | 9/1985 |

OTHER PUBLICATIONS

Wagner Instructional Packet, "The Right Tool for the Right Job," 2001 Wagner Spray Tech., (16 pgs.).

* cited by examiner

ROLLER REST ENCLOSURE

BACKGROUND OF THE INVENTION

The present invention relates to a storage apparatus for paint roller sleeves, and in particular to such an apparatus that allows the painter to temporarily store a paint roller sleeve to prevent the paint from solidifying or dripping onto the environment.

Painters often use paint roller assemblies to apply paint to a surface. A paint roller assembly typically comprises a roller sleeve supported by a roller handle assembly. The roller handle assembly comprises a handle member and a roller cage. The roller cage is supported by the handle member for rotation about a roller axis. The roller sleeve is detachably attached to the roller cage. During use, the user grasps the handle member to roll the roller sleeve about the roller axis first in paint (usually in a tray) and then onto the surface to be coated.

Conventionally, paint roller sleeves are considered disposable. However, the paint roller sleeves are often cleaned and reused several times before eventually being discarded. If the entire paint roller assembly is cleaned so that the roller sleeve may be reused, as much paint as possible is first removed from the roller sleeve. The roller sleeve and roller assembly are then rinsed in the appropriate solvent.

However, it is often desirable to temporarily store a paint roller sleeve with paint on it in such a way that the paint will not dry on the roller sleeve or drip onto the environment.

SUMMARY OF THE INVENTION

Apparatus for temporary storage of paint roller sleeves, the paint roller sleeves being mounted on a roller cage, the roller cage being connected to a handle assembly, the apparatus comprising:

An enclosure receiving the paint roller sleeve, the roller cage, and a portion of the handle assembly; and a cover sealing the enclosure.

A principal object and advantage of the present invention is that it permits a paint roller sleeve to be stored for long periods of time without drying out.

Another principal object and advantage of the present invention is that it prevents paint from a paint roller sleeve from dripping onto the environment.

Another principal object and advantage of the present invention is that it can be stood on a base, hung from a hook, or hung from a ladder rung.

DETAILED DESCRIPTION OF THE PREFERRED EMBODIMENTS

Figure 2:
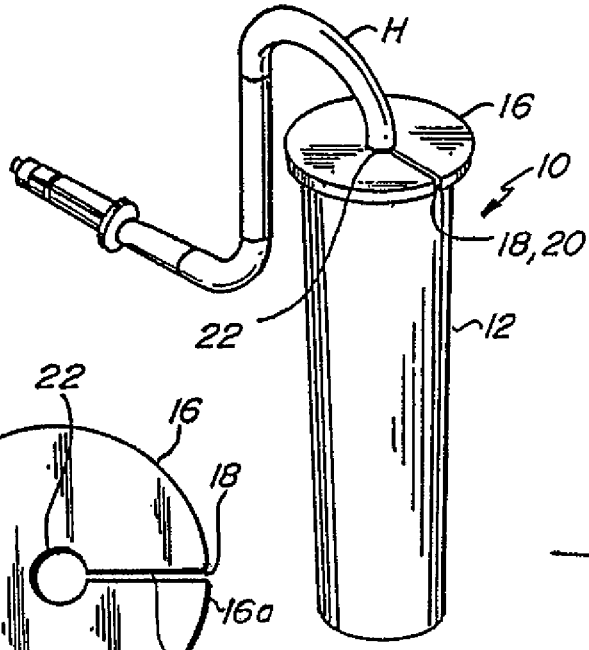
FIG. 2 is a perspective view of one embodiment of the present invention.
Figure 2A:
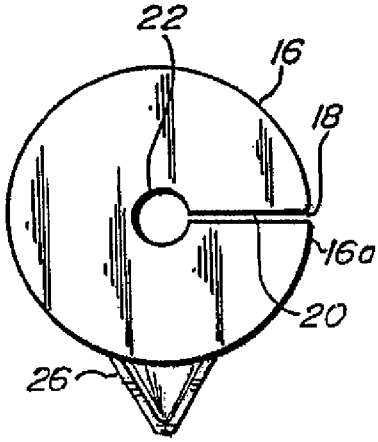
FIG. 2A is a top plan view of the apparatus of the present invention.

The present invention is generally shown in the Figures as reference numeral 10.

Figure 1:
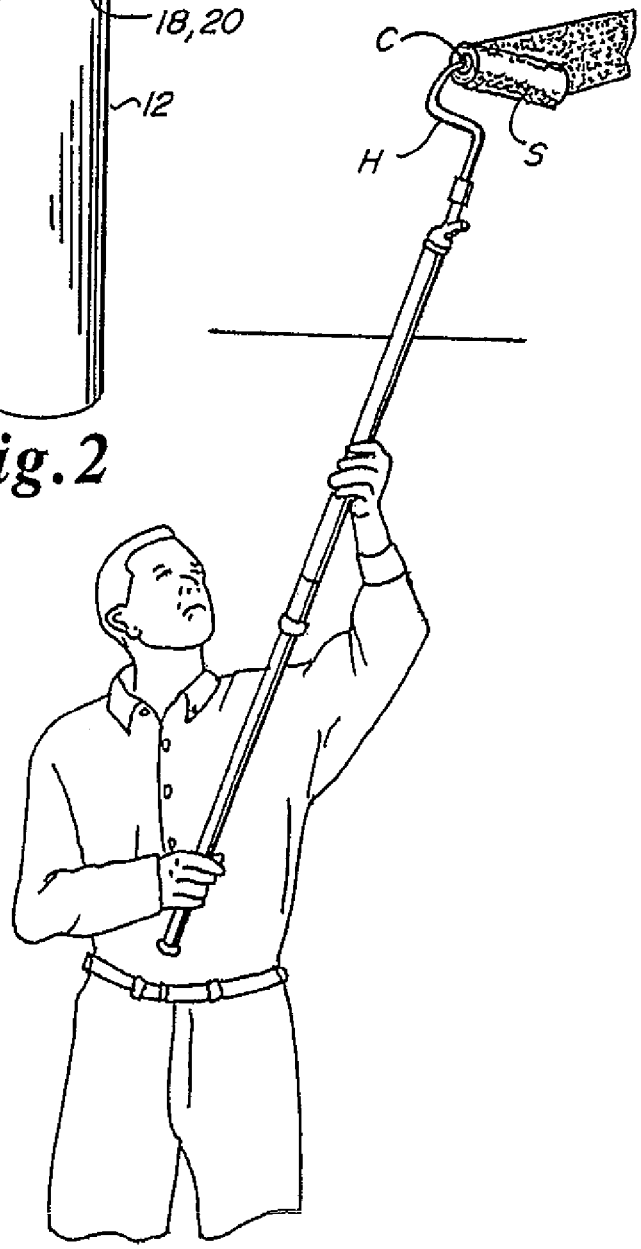
Fig.1 Prior Art
FIG. 1 is a perspective view of a user employing a paint roller for use with the present invention.

The present invention is an apparatus 10 for temporary storage of paint roller sleeves S which are mounted on a roller cage C, the roller cage C being connected to a handle assembly H, as shown in FIG. 1. The apparatus may be constructed from any suitable material, for example, PVC.

The apparatus 10 comprises an enclosure 12 receiving the paint roller sleeve S, the roller cage C, and a portion P of the handle assembly H and fully enclosing the paint roller sleeve S and the roller cage C. The enclosure is approximate one to two inches longer than the roller and sleeve.

Figure 4:
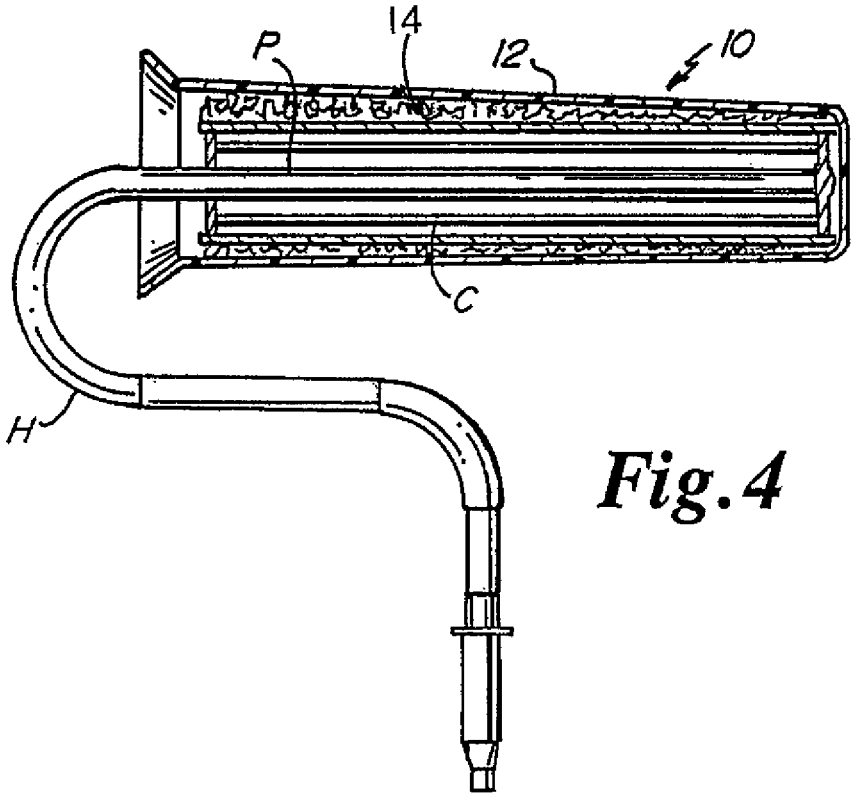
FIG. 4 is a cross-section taken at approximately the lines 4 of FIG. 3.

Preferably, the enclosure 12 applies slight squeezing pressure to the paint roller sleeve S, to squeeze some paint out of the sleeve S. To accomplish this, the enclosure 12 may also preferably comprise a tapered core 14 engaging the roller sleeve S, as best seen in FIG. 4.

In order to prevent the paint on the roller sleeve S from drying, and also to prevent the paint from dripping onto the environment, in one embodiment the apparatus 10 further comprises, in a first embodiment, a cover 16 sealing the enclosure 12, as seen in FIG. 2. Preferably, the cover 16 has an opening 18 receiving a portion P of the handle assembly H. Most preferably, the cover 16 is flexible and further comprises a slot 20 intersecting an edge 16*a* of the cover 16 and an aperture 22 approximately central to the cover 16.

Figure 3:
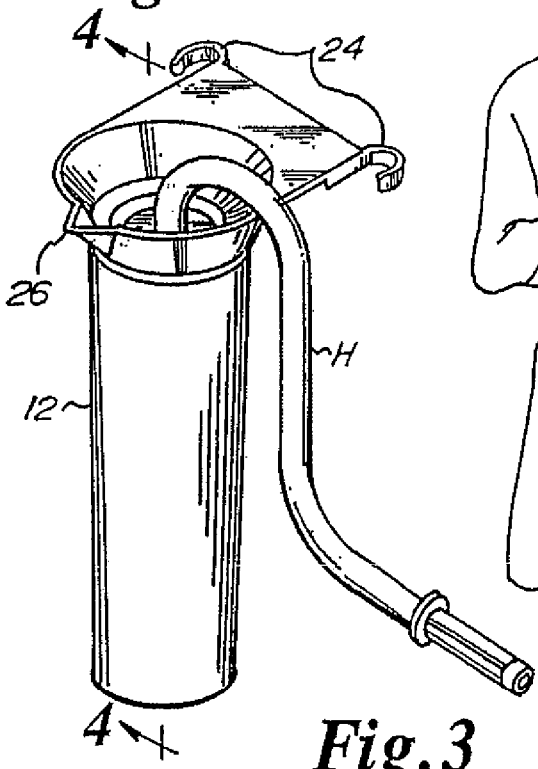
FIG. 3 is a perspective view of a second embodiment of the present invention.

A second embodiment of the apparatus 10 is shown in FIG. 3. In the second embodiment, in addition to having a cover 16, the apparatus 10 further comprises a hook portion 24 for hanging the enclosure and preferably a spout 26 for pouring paint from the enclosure 12. In addition, or alternatively, the apparatus 10 may further comprise a ladder rung hanger 27 for hanging the apparatus on the rung of a ladder.

Figure 5:
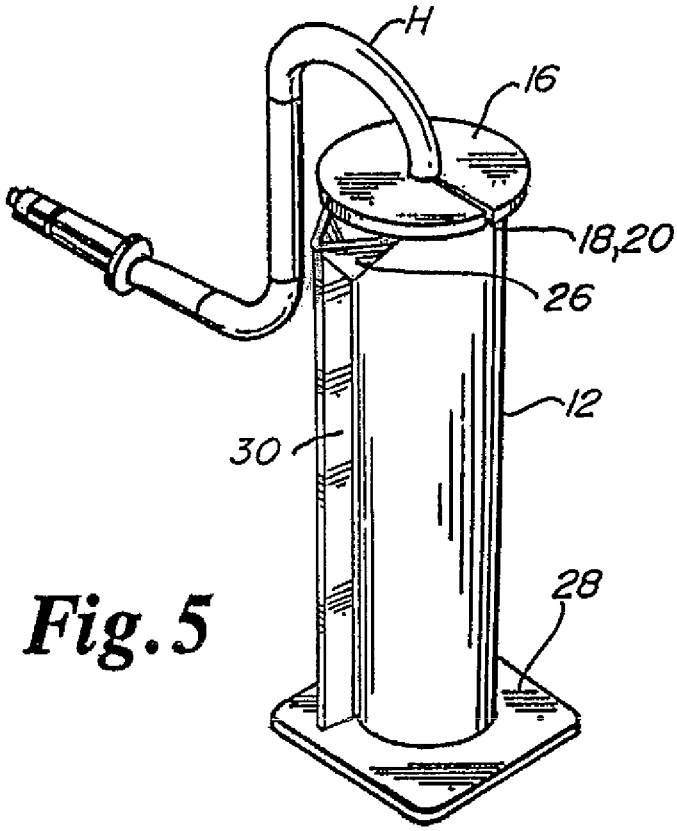
FIG. 5 is a perspective view of a third embodiment of the present invention.

A third embodiment of the apparatus 10 is shown in FIG. 5. Like the first embodiment, the apparatus 10 has a cover 16 sealing the enclosure 12. In addition, the apparatus 10 has a base 28 for standing the enclosure 12 on a surface (not shown).

Figure 6:
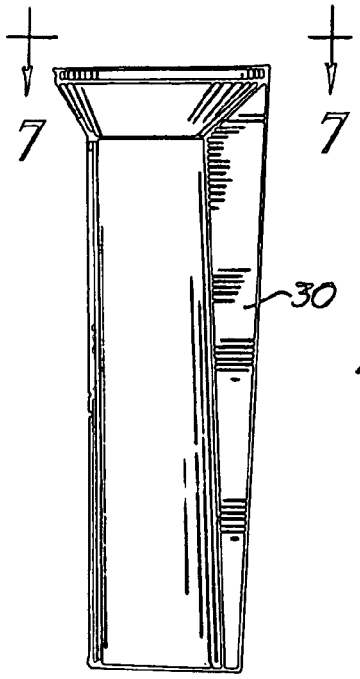
FIG. 6 is a perspective view of another embodiment of the present invention.
Figure 7:
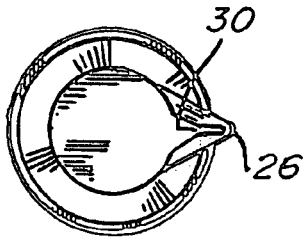
FIG. 7 is a cross-section taken at approximately the lines 7 of FIG. 6.
Figure 8:
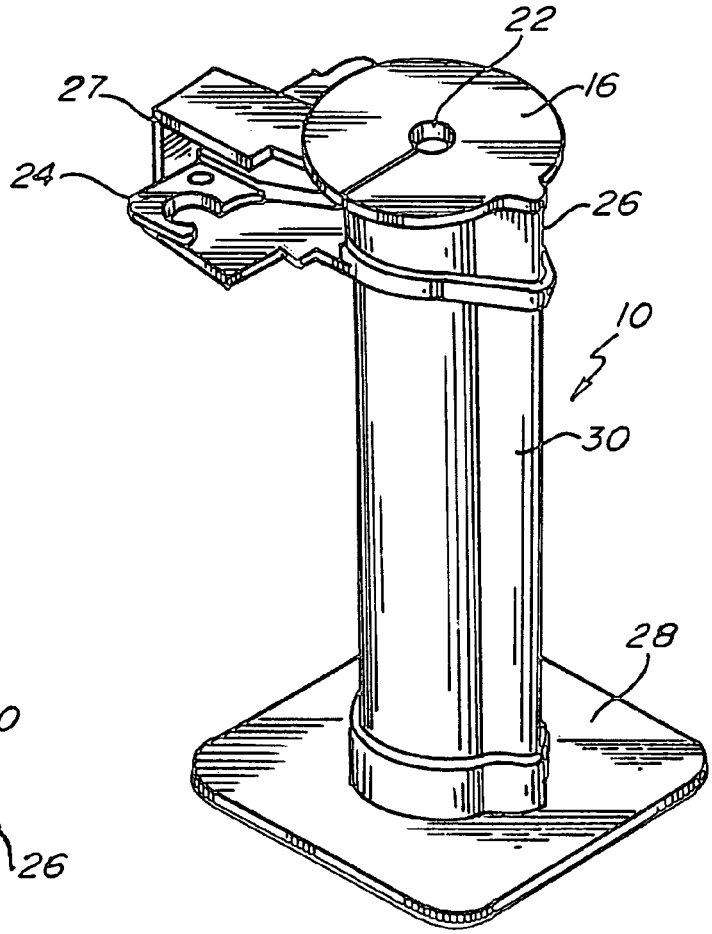
FIG. 8 is a perspective view of a fourth embodiment of the present invention.

A fourth embodiment of the apparatus 10 is shown in FIG. 6. In addition to the features of the earlier embodiments, the fourth embodiment has a paint channel 30 receiving paint from the roller sleeve S and thereby keeping the paint within the apparatus 10, rather than allowing the paint to come out. This permits a paint roller sleeve to be kept fresh for up to three weeks. If a cover 16 is added, the roller sleeve may be kept fresh indefinitely. The paint channel 30 also provides an air path for easy removal and insertion of the roller sleeve S, i.e., as the roller sleeve S is inserted into the apparatus 10, displaced air is forced out of the apparatus 10 through the paint channel 30.

To use the apparatus 10, the user, rather than removing the paint roller sleeve S from the cage C, simply inserts the roller sleeve S into the enclosure 12. If it is desired to store the roller sleeve while minimizing evaporation and drying of paint, a cover 16 may be placed on the enclosure 12, as in the first embodiment. Alternatively, the user may pour excess paint from the enclosure 12 using the spout 26 and then hang the enclosure on some object such as a ladder. Alternatively, the user may stand the enclosure 12 on its base 28.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described below. All publications, patent applications, patents, and other references mentioned herein are incorporated by reference in their entirety to the extent allowed by applicable law and regulations. In case of conflict, the present specification, including definitions, will control.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. Apparatus for temporary storage of paint roller sleeves, the paint roller sleeves being mounted on a roller cage, the roller cage being connected to a handle assembly, the apparatus comprising an enclosure receiving the paint roller sleeve, the roller cage, and a portion of the handle assembly and fully enclosing the paint roller sleeve and the roller cage, wherein the enclosure applies slight squeezing pressure to the paint roller sleeve, wherein the enclosure further comprises a top and a bottom and a tapered core continuously tapered from the top to the bottom and continuously engaging the paint roller sleeve from the top to the bottom further comprising a channel receiving paint squeezed out of the roller sleeve.

2. The apparatus of claim 1, further comprising a cover sealing the enclosure.

3. The apparatus of claim 2, wherein the cover further comprises an opening for receiving a portion of the handle assembly.

4. The apparatus of claim 3, wherein the cover is flexible, and wherein the opening further comprises a slot intersecting an edge of the cover and an expanded portion approximately central to the cover.

5. The apparatus of claim 1, further comprising a base connected to the enclosure for standing the enclosure on a surface.

6. The apparatus of claim 1, further comprising a hook portion for hanging the enclosure.

7. The apparatus of claim 6, further comprising a spout for pouring paint from the enclosure.

8. The apparatus of claim 1, further comprising a ladder rung hangar adapted to hand the enclosure on a ladder rung.

9. The apparatus of claim 7, further comprising a channel receiving paint squeezed out of the roller sleeve, the channel communicating with the spout.

10. The apparatus of claim 9, wherein the channel is formed by the tapered core.

11. Apparatus for temporary storage of paint roller sleeves, the paint roller sleeves being mounted on a roller cage, the roller cage being connected to a handle assembly, the apparatus comprising an enclosure receiving the paint roller sleeve, the roller cage, and a portion of the handle assembly and fully enclosing the paint roller sleeve and the roller cage, wherein the enclosure applies slight squeezing pressure to the paint roller sleeve, wherein the enclosure further comprises a top and a bottom and a tapered core continuously tapered from the top to the bottom and continuously engaging the paint roller sleeve from the top to the bottom, a spout for pouring paint from the enclosure, a channel receiving paint squeezed out of the roller sleeve, the channel communicating with the spout, and wherein the channel is formed by the tapered core.

* * * * *